United States Patent [19]

Erasmus

[11] Patent Number: 4,628,658

[45] Date of Patent: Dec. 16, 1986

[54] SUPPORT PACK

[75] Inventor: Jacobus P. Erasmus, Transvaal, South Africa

[73] Assignee: H L & H Timber Products (Proprietary) Limited, Transvaal, South Africa

[21] Appl. No.: 692,383

[22] Filed: Jan. 17, 1985

[30] Foreign Application Priority Data

Jan. 18, 1984 [ZA] South Africa ..... 84/0363

[51] Int. Cl.[4] ..... E04B 1/10; E04C 1/04; E04C 3/00; E21D 15/00

[52] U.S. Cl. ..... 52/561; 52/733; 405/288

[58] Field of Search ..... 52/233, 561, 569, 572, 52/733; 405/288, 289, 272, 273; 248/351

[56] References Cited

U.S. PATENT DOCUMENTS

| | | | |
|---|---|---|---|
| 563,405 | 7/1896 | Peppard | 405/273 |
| 769,656 | 9/1904 | Kidder | 52/569 |
| 834,024 | 10/1906 | Pierce | 52/572 |
| 1,773,579 | 8/1930 | Flath | 405/273 |
| 1,787,199 | 12/1930 | Huntoon | 405/273 |
| 1,938,215 | 12/1933 | Corcoran | 52/569 |
| 4,133,155 | 1/1979 | Oelrich | 52/729 |

FOREIGN PATENT DOCUMENTS

| | | | |
|---|---|---|---|
| 45952 | 3/1980 | Japan | 405/273 |
| 45953 | 3/1980 | Japan | 405/273 |

*Primary Examiner*—Carl D. Friedman
*Assistant Examiner*—Michael Safavi
*Attorney, Agent, or Firm*—Barnes & Thornburg

[57] ABSTRACT

This invention relates to a composite type mine support pack and a component for building the pack. The pack components are identical with each including an elongated timber element, a first brick which is attached to the element adjacent its one end and a second brick which is attached to the element on the same side of the element and in alignment with the first brick in the axial direction of the element with the second brick being spaced from the other end of the element by a distance equal to twice the dimension of the first brick when measured in the axial direction of the timber element plus the distance by which the first brick is spaced from its end of the timber element. Preferably the bricks are made from timber. The pack consists of superimposed layers of the components with the bricks on each component resting on those of the components above and below it.

19 Claims, 3 Drawing Figures

SUPPORT PACK

FIELD OF THE INVENTION

This invention relates to a composite type mine support pack and more particularly to a component for building the pack.

SUMMARY OF THE INVENTION

A support pack according to the invention consists of superimposed layers of elongated timber elements each of which carries at least two spaced bricks which are attached to it with each brick on each timber element lying on a timber element beneath it.

In a preferred form of the invention the bricks are made from timber with the grain of the timber being normal to the grain of the elements to which they are attached. The bricks are conveniently stapled to the elongated elements. The staples are preferably made from a yieldable material such as mild steel and embrace the bricks in a direction normal to their grain.

In one form of the invention the bricks on each timber element of the pack are identically positioned. Preferably a first brick on each element is fixed to the element adjacent its one end with a second brick, on the same side of the element, being spaced from the opposite end of the element by a distance equal to twice the cross sectional area of the brick plus the distance by which the first brick is spaced from its end of the timber element. Preferably the bricks have substantially the same cross-sectional area as the timber elements.

A component for use in constructing a support pack according to the invention includes an elongated timber element, a first brick attached to the element adjacent its one end and a second brick, on the same side of the timber element as the first, spaced from the opposite end of the timber element by a distance equal to twice the cross-sectional area of the brick plus the distance by which the first brick is spaced from its end of the timber element.

In a preferred form of the invention the bricks are made from timber and are attached to the elongated element so that the direction of their grain is normal to the direction of the grain of the elontaged element. The bricks are conveniently substantially square and have the same cross-sectional dimension as that of the elongated element.

Further according to the invention the bricks are stapled to the elongated elements by yieldable wire which embraces the bricks in a direction normal to the direction of their grain.

BRIEF DESCRIPTION OF THE DRAWINGS

An embodiment of the invention is now described by way of example only with reference to the drawings in which.

DETAILED DESCRIPTION OF THE PREFERRED EMBODIMENT

Figure 1:
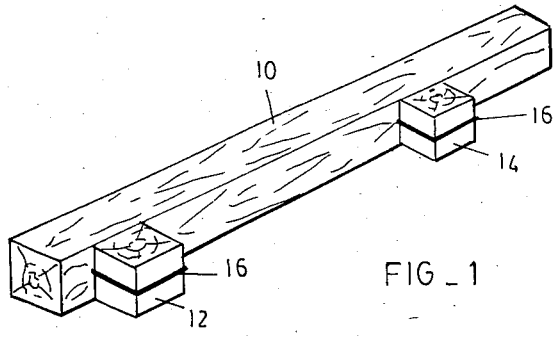
FIG. 1 is a perspective view of the pack component of the invention.

The pack component of the invention is shown in FIG. 1 of the drawings to consist of an elongated timber element 10 which has two timber bricks 12 and 14 stapled to it by staples 16.

The grain of the timber of the element 10 lies in its axial direction.

Figure 2:
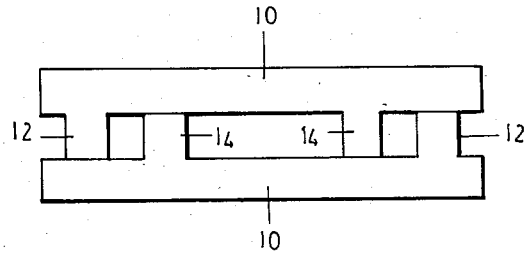
FIG. 2 is a plan view of two of the FIG. 1 components laid side by side.
Figure 3:
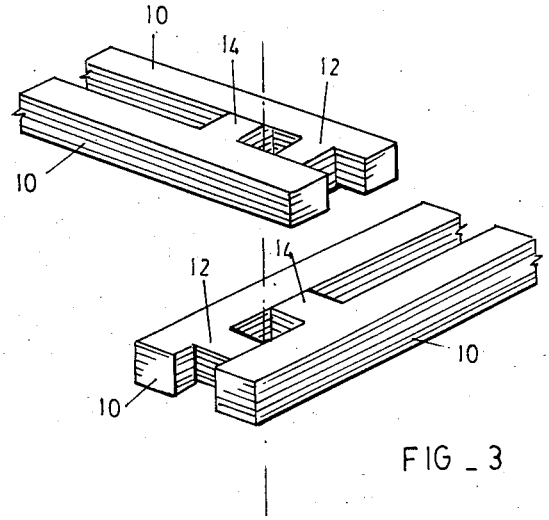
FIG. 3 is an exploded fragmentary view of the FIG. 1 components at a corner of the support pack of the invention.

The bricks 12 and 14 are substantially square and have the same cross-sectional area as the timber element 10. The bricks are attached to the timber element so that their grain is normal to the direction of the grain of the element 10. In FIGS. 2 and 3 the bricks are shown integral with the timber elements to which they are attached for clarity of illustration.

The staples 16 are made from mild steel wire which will yieldably restrain the bricks against cracking and bursting in use.

A sixteen point pack is built from the FIG. 1 components by arranging two pairs of the components in a spaced parallel relationship on the foot wall to form the base of the pack. Each pair of components is arranged as is illustrated in FIG. 2 with the bricks on each timber element 10 facing the other element. As is more clearly seen in this drawing than in FIG. 1 the brick 14 on each timber element 10 is spaced from the end of the element by a distance equal to twice the width of the brick plus the distance by which the brick 12 is spaced from its end of the element.

The distance separating the outer elements 10 of the base layer of the pack is equal to the distance separating the bricks 12 in the FIG. 2 arrangement.

Two further pairs of components, which are arranged identically to the FIG. 2 arrangement, are then laid on the base layer of the pack at right angles to the timber elements of the base layer with the timber elements lying transversely over the elements 10 and the bricks 12 and 14 of the bottom layer, as illustrated in FIG. 3.

The remainder of the pack is constructed in the same manner as described above resulting in the pack having effectively a square timber pillar at each corner. To further rigidify the pack elongated props having the same cross-sectional area as the bricks could be located in the vertical passages, indicated by the dotted line in FIG. 3, in each corner pillar of the pack.

I claim:

1. A support pack including superimposed layers of elongated timber elements and two timber bricks attached in a spaced relationship to each elongated timber element, the grain direction of each timber brick is normal to the long axis of the elongated timber element, the layers being so arranged that the timber bricks on each timber element bear on an adjacent elongated timber element.

2. A support pack as claimed in claim 1 in which the grain direction of each elongated timber element lies in the direction of the long axis of the elongated timber element.

3. A support pack as claimed in claim 1 in which a first brick on each timber element is attached to the timber element adjacent one end with a second brick aligned with the first brick in the axial direction of the timber element and spaced from an opposite end of the element by a distance equal to twice the dimension of the first brick when measured in the axial direction of the timber element plus the distance by which the first brick is spaced from the adjacent one end of the timber element.

4. A support pack as claimed in claim 3 in which the height of each brick when measured in the direction of its grain corresponds to the cross-sectional height of the timber element to which it is attached so that upper and lower surfaces of the bricks are substantially flush with upper and lower surfaces of the timber element.

5. A support pack as claimed in claim 1 in which the timber elements are substantially square in cross-section and the bricks are square and have cross-sectional dimensions which correspond to the cross-sectional dimensions of the timber element.

6. A support pack as claimed in claim 1 in which the timber bricks are attached to the elongated timber elements by staples which are made from yieldable mild steel.

7. A support pack including superimposed layers of elongated timber elements and two timber bricks attached in a spaced relationship to the timber elements by staples which are made from mild steel, the pack components being so arranged that the timber bricks on each timber element bear on an adjacent timber element.

8. A support pack as claimed in claim 7 in which the grain direction of each elongated timber element lies in the direction of the long axis of the elongated timber element.

9. A support pack as claimed in claim 7 in which a first brick of said timber bricks on each timber element is attached to the timber element adjacent one end, and a second brick aligned with the first brick in the axial direction of the timber element and spaced from an opposite end of the element by a distance equal to twice the dimension of the first brick when measured in the axial direction of the timber element plus the distance by which the first brick is spaced from the adjacent one end of the timber element.

10. A support pack as claimed in claim 9 in which the height of each brick when measured in the direction of its grain corresponds to the cross-sectional height of the timber element to which it is attached so that upper and lower surfaces of bricks are substantially flush with the upper and lower surfaces of the timber element.

11. A support pack component for use in constructing a support pack including an elongated timber element, a first timber brick attached to the elongated timber element adjacent one end, and a second timber brick attached to the element on the same side of the elongated timber element and in alignment with the first timber brick in the axial direction of the elongated timber element, the second timber brick being spaced from another end of the elongated timber element by a distance equal to twice the dimension of the first timber brick when measured in the axial direction of the elongated timber element plus the distance by which the first timber brick is spaced inward from the adjacent one end of the elongated timber element, and the timber bricks are attached to the elongated timber element with the grain direction of each timber brick normal to the long axis of the elongated timber element.

12. A support pack component as claimed in claim 11 in which the timber element is substantially square in cross-section and the bricks are substantially cubical and have cross-sectional dimensions which correspond to the cross-sectional dimensions of the timber element.

13. A support pack component as claimed in claim 11 in which the timber bricks are attached to the elongated timber elements by staples which are made from yieldable mild steel.

14. A support pack component as in claim 11 in which the grain direction of the elongated timber element lies in the direction of the long axis of the elongated timber element.

15. A support pack component as claimed in claim 11 in which the height of each brick when measured in the direction of its grain corresponds to the cross-sectional height of the timber element to which it is attached so that upper and lower surfaces of the bricks are substantially flush with upper and lower surfaces of the timber element.

16. A support pack component for use in constructing a support pack including an elongated timber element, a first timber brick attached to the elongated timber element adjacent one end, and a second timber brick attached to the element on the same side of the elongated timber element and in alignment with the first timber brick in the axial direction of the elongated timber element, the second timber brick being spaced from another end of the elongated timber element by a distance equal to twice the dimension of the first timber brick when measured in the axial direction of the elongated timber element plus the distance by which the first timber brick is spaced inward from the adjacent one end of the elongated timber element, and the timber bricks are attached to the elongated timber element by staples which are made from yieldable mild steel.

17. A support pack component as in claim 16 in which the grain direction of the elongated timber element lies in the direction of the long axis of the elongated timber element.

18. A support pack component as claimed in claim 16 in which the timber element is substantially square in cross-section and the bricks are substantially cubical and have cross-sectional dimensions which correspond to the cross-sectional dimensions of the timber element.

19. A support pack component as claimed in claim 16 in which the height of each brick when measured in the direction of its grain corresponds to the cross-sectional height of the timber element to which it is attached so that upper and lower surfaces of the bricks are substantially flush with upper and lower surfaces of the timber element.

* * * * *